US009957914B2

(12) United States Patent
Mandorfer et al.

(10) Patent No.: US 9,957,914 B2
(45) Date of Patent: May 1, 2018

(54) ENGINE BLOCK OF A DIESEL ENGINE WITH INTEGRATED CYLINDER HEAD, AND CASTING METHOD

(71) Applicant: STEYR Motors GmbH, Steyr (AT)

(72) Inventors: Rudolf Mandorfer, Bad Hall (AT); Michael Aschaber, Aschach (AT); Josef Wagner, Wolfsbach (AT)

(73) Assignee: Steyr Motors GmbH, Steyr (AT)

( * ) Notice: Subject to any disclaimer, the term of this patent is extended or adjusted under 35 U.S.C. 154(b) by 0 days. days.

(21) Appl. No.: 14/771,029

(22) PCT Filed: Dec. 10, 2013

(86) PCT No.: PCT/AT2013/000198

§ 371 (c)(1),
(2) Date: Aug. 27, 2015

(87) PCT Pub. No.: WO2015/085333

PCT Pub. Date: Jun. 18, 2015

(65) Prior Publication Data

US 2016/0273478 A1 Sep. 22, 2016

(51) Int. Cl.
*F02F 1/14* (2006.01)
*B22C 9/10* (2006.01)
(Continued)

(52) U.S. Cl.
CPC ..... *F02F 1/14* (2013.01); *B22C 9/10* (2013.01); *B22D 15/02* (2013.01); *F02B 9/02* (2013.01);
(Continued)

(58) Field of Classification Search
CPC ..... F02F 1/16; F02F 1/002; F02F 1/40; F02P 2003/028; B22D 15/02
See application file for complete search history.

(56) References Cited

U.S. PATENT DOCUMENTS 3,691,914 A * 9/1972 Reisacher ..... F02F 1/002 123/193.3
4,092,956 A * 6/1978 List ..... F02F 1/002 123/193.3
(Continued)

FOREIGN PATENT DOCUMENTS

AT 382429 B 2/1987
DE 1995270 U 10/1968
(Continued)

OTHER PUBLICATIONS

International Search Report for PCT/AT2013/000198, dated Oct. 24, 2014.

*Primary Examiner* — Kevin A Lathers
(74) *Attorney, Agent, or Firm* — Bachman & LaPointe, PC

(57) ABSTRACT

An engine block of a diesel engine cast integrally with the cylinder head, with a number of cylinders in line, including an outer wall (21) and a cylinder wall (13) for each cylinder with a first cooling space (22) for a liquid cooling medium and with a second cooling space (25) on top of a cylinder ceiling (14) with openings (15,16) for gas exchange valves, the first cooling space (22) enclosing all the cylinder walls (13) entirely. In order to strengthen and cooling the vulnerable zone at the transition from cylinder wall (13) to cylinder ceiling (14) the first cooling space of adjacent cylinders forms a gap (23) with a width (35) constant or increasing from top to bottom.

6 Claims, 7 Drawing Sheets

(51) Int. Cl.

| | |
|---|---|
| ***F02F 1/00*** | (2006.01) |
| ***F02F 1/10*** | (2006.01) |
| ***F02F 1/40*** | (2006.01) |
| ***F02F 1/24*** | (2006.01) |
| ***B22D 15/02*** | (2006.01) |
| ***F02B 9/02*** | (2006.01) |
| *F01P 3/02* | (2006.01) |

(52) U.S. Cl.
CPC ..... *F02F 1/002* (2013.01); *F02F 1/108* (2013.01); *F02F 1/242* (2013.01); *F02F 1/40* (2013.01); *F01P 2003/028* (2013.01); *F02F 2001/104* (2013.01)

(56) References Cited

U.S. PATENT DOCUMENTS

| | | | | | |
|---|---|---|---|---|---|
| 4,230,087 | A | | 10/1980 | Abe et al. | |
| 4,365,594 | A | * | 12/1982 | Obermayer | F02F 1/002 123/193.3 |
| 4,708,105 | A | * | 11/1987 | Leydorf, Jr. | F02F 7/0058 123/193.3 |
| 4,763,619 | A | * | 8/1988 | Eitel | F02F 7/0053 123/193.3 |
| 5,404,846 | A | * | 4/1995 | VanRens | F02B 61/045 123/193.2 |
| 6,298,899 | B1 | | 10/2001 | Baltz et al. | |
| 2002/0124815 | A1 | * | 9/2002 | Ishiguro | F02F 1/242 123/41.82 R |

FOREIGN PATENT DOCUMENTS

| | | | |
|---|---|---|---|
| DE | 1938134 | A1 | 1/1971 |
| DE | 10033271 | A1 | 1/2001 |
| DE | 102011105388 | A1 | 12/2012 |
| GB | 1081529 | A | 8/1967 |
| JP | 0771310 | A | 3/1995 |

* cited by examiner

PROIR ART

ENGINE BLOCK OF A DIESEL ENGINE WITH INTEGRATED CYLINDER HEAD, AND CASTING METHOD

BACKGROUND OF THE INVENTION

The invention relates to an engine block of a diesel engine cast integrally with the cylinder head, with a number of cylinders in line, including an outer wall and a cylinder wall for each cylinder with a first cooling space for a liquid cooling medium between them and with a second cooling space on top of a cylinder ceiling with openings for gas exchange valves, the first cooling space enclosing all the cylinders entirely and extending upwards beyond the cylinder ceiling.

This design is also known as "Monoblock". It avoids the drawbacks of the design with a separate cylinder head: The bolts joining the cylinder head to the engine block, and the gasket between them. It is therefore particularly suitable for Diesel engines of high performance. The high performance entails high pressures and needs intensive cooling by the liquid cooling medium, in particular around the cylinder ceilings. However, this design is demanding for the casting shop.

Such an engine is known from DE 19 38 134, for instance. Its cylinder walls are circumflown by a cooling liquid (usually water). In order to provide sufficient rigidity to the surrounding of the cylinder ceilings, these are incorporated in a through horizontal wall. But this divides the two cooling spaces, the cylinder walls are structurally vulnerable and not directly circumflown by the cooling liquid.

The German Utility Model 1 995 270 also discloses an engine in monoblock design, wherein the cylinder ceilings are united in a through plate. The cooling space enclosing the cylinder walls therefore does not reach beyond the cylinder ceilings all around. The sensible transition zone between cylinder walls and cylinder ceilings thus is not circumflown by the cooling water.

The Austrian Patent 382 429 discloses a further generic engine, including injection units in the cylinder head supplied with fuel by a common rail and with a first cooling space that rises beyond the cylinder ceilings, but without overlapping them. As can be seen, the cooling water passes from the first cooling space to the second cooling space (in the cylinder head) through a horizontal bore drilled from outside and blocked. This cannot provide a cooling water flow to the upper cooling space sufficient for a high performance engine.

The JP 07-071310 relates to a further engine in monoblock design. According to FIG. 3, the first cooling space overlaps the cylinder ceiling in the region of the valves, but only slightly. In order to achieve the desired improvement of structural strength and of cooling, overlap must coincide with the width of the gaps between adjacent cylinders around the cylinder walls which increases from top to bottom.

DE 100 33 271 B4 relates to the casting core for the cooling jacket of an engine of conventional design, not monoblock. In this design the problem of the transition between cylinder wall and cylinder ceiling does not arise. The described casting process uses inserts, but inserted into the core. This is time consuming, limiting the design and the insert must be destroyed when unmolding the cast part.

When preparing the casting mould for such an engine block, the core parts corresponding to the cooling space around the cylinder wall must be made with a draft angle of some degrees of angle. This is necessary in order to enable the core parts to be extracted from the core mould (also called core box) without being damaged. This draft angle is always featured, even if not visible in conventional drawings because it is only of some degrees of angle. It is of particular importance with very thin core parts corresponding to the regions of the water space between adjacent cylinders. Thin core parts are very fragile.

The draft angle of the core part for this region entails that it is wider near the cylinder ceiling than at its lower end. This has the consequence that the wall thickness of the cylinder wall is smaller on top, in the particularly vulnerable transitional region between cylinder wall and cylinder ceiling. This vulnerable region limits the specific performance of an engine.

SUMMARY OF THE INVENTION

The present invention sets out to eliminate this vulnerability. According to the invention the cooling space between the cylinder walls of adjacent cylinders has a gap with a width constant or increasing from top to bottom. Top and bottom relates, as in the following, to an vertically set engine with the cylinder ceiling on top and the crankshaft at the bottom. Likewise horizontal and vertical.

This measure has the effect that the cylinder wall is not impaired or (if the width of the gap increases towards the bottom or if the gap is bridged) even strengthened and that the transitional region is intensely cooled. This allows a further increase of the specific performance.

Preferably the first cooling space overlaps the cylinder ceiling at least in the region of the exhaust valves. The overlap entails a further increase of the cooling of the vulnerable zone, particularly advantageous in the region of the exhaust valves.

When the engine block includes wall parts separating the first cooling space from the second cooling space, an advantageous embodiment comprises two horizontal bores, one drilled from one outer wall, the other drilled from the opposite outer wall, and one of them ending in the region of the fuel injector. This enables the cooling liquid rising from the first cooling space to form a jet directed towards the injector and so provides effective cooling of the sensitive injector. With two such horizontal bores arranged in pairs per cylinder, the second cooling space is fully integrated in the circulation of the cooling fluid.

From the manufacturing point of view, drilling these bores from outside is very easy, considering that the engine block undergoes machining at various locations after casting. The opening of the bores in the outer wall is easily plugged in the same way as other core positioning bores.

The invention also consists in a casting method particularly suitable for providing for the gap between adjacent cylinders according to the invention. This, assuming that the parts of the core are formed separately from suitably prepared sand in core moulds and that the core part corresponding to the gap between adjacent cylinders is formed by means of separate inserts in each core mould, the shape of which corresponds to the width of the gap or the variable width of the gap, as the case may be.

According to the invention the insert of constant or diminishing width is slid into the core mould for shaping the core (the core box) in vertical direction. To this end vertical guideways are provided in the core mould and on the insert. When the core is taken out of the core mould, the insert is lifted out together with the core part—therefore the guideways—and the insert is removed sideways. Thus, only one simple additional core tool is required. The insert consists of a durable material and therefore can be used again. Further, the side of the insert opposite the guideways can have a freely determined shape.

BRIEF DESCRIPTION OF THE DRAWINGS

In the following, the invention will be described and commented along with the following drawings.

DETAILED DESCRIPTION

Figure 1:
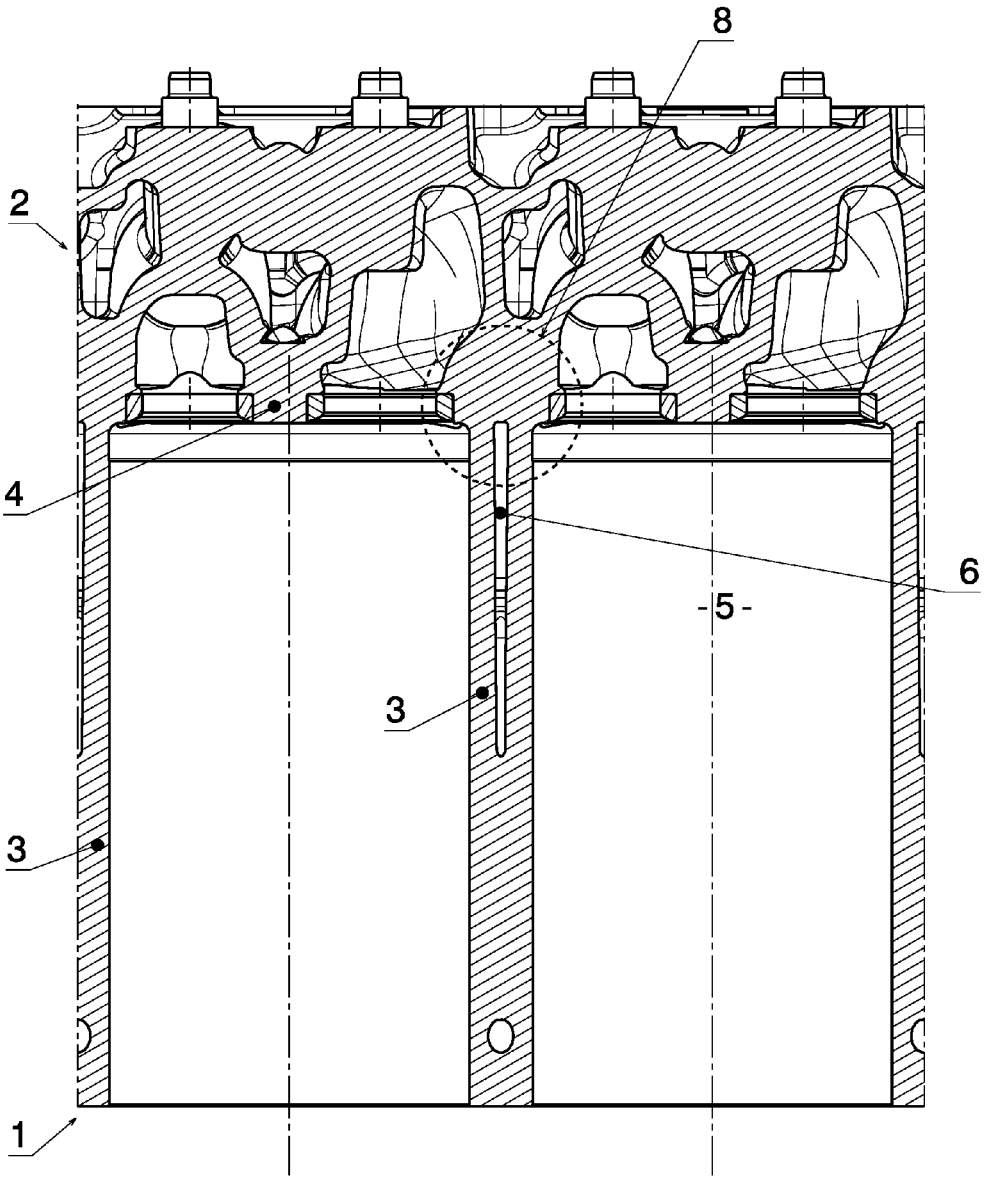
FIG. 1: A longitudinal section of a generic engine according to the state of the art.

Referring to FIG. 1, the problem the invention sets out to solve will be explained with regard to the state of the art. The engine block 1 with a number of cylinders in line is cast integrally with the cylinder head part 2. The cylinder walls 3 enclose the combustion space 5 and are enclosed by cooling spaces and circulated around by a cooling liquid (normally water). In the casting mould, the cooling spaces are materialized by sand core parts. These are formed in special core moulds. In order to withdraw the core parts from the core mould without damage, a draft angle of some degrees must be implemented; all the more the thinner and more fragile the core parts are. The core is particularly thin in the gap 6 between the cylinder walls 3 of adjacent cylinders. Due to the draft angle, the width of the gap 6 increases from below up to the cylinder ceiling 4 and the wall thickness of the cylinder walls therefore decreases. By this, the cylinder walls 3 are thinnest in the transition to the cylinder ceiling 4, the region of highest mechanical and thermic strain. This weakness limits the specific power of the engine, lest cracks would occur in this region.

Figure 2:
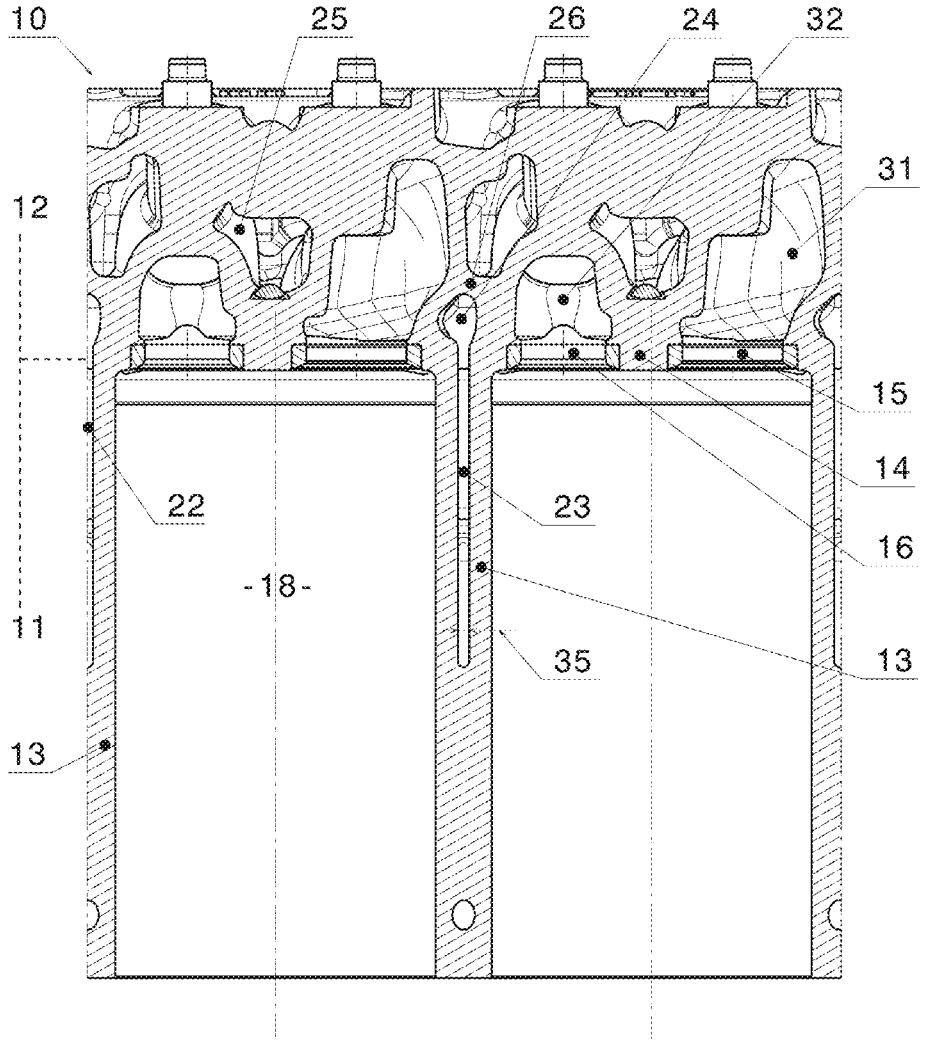
FIG. 2: A longitudinal section of a part of an engine according to the invention.
Figure 3:
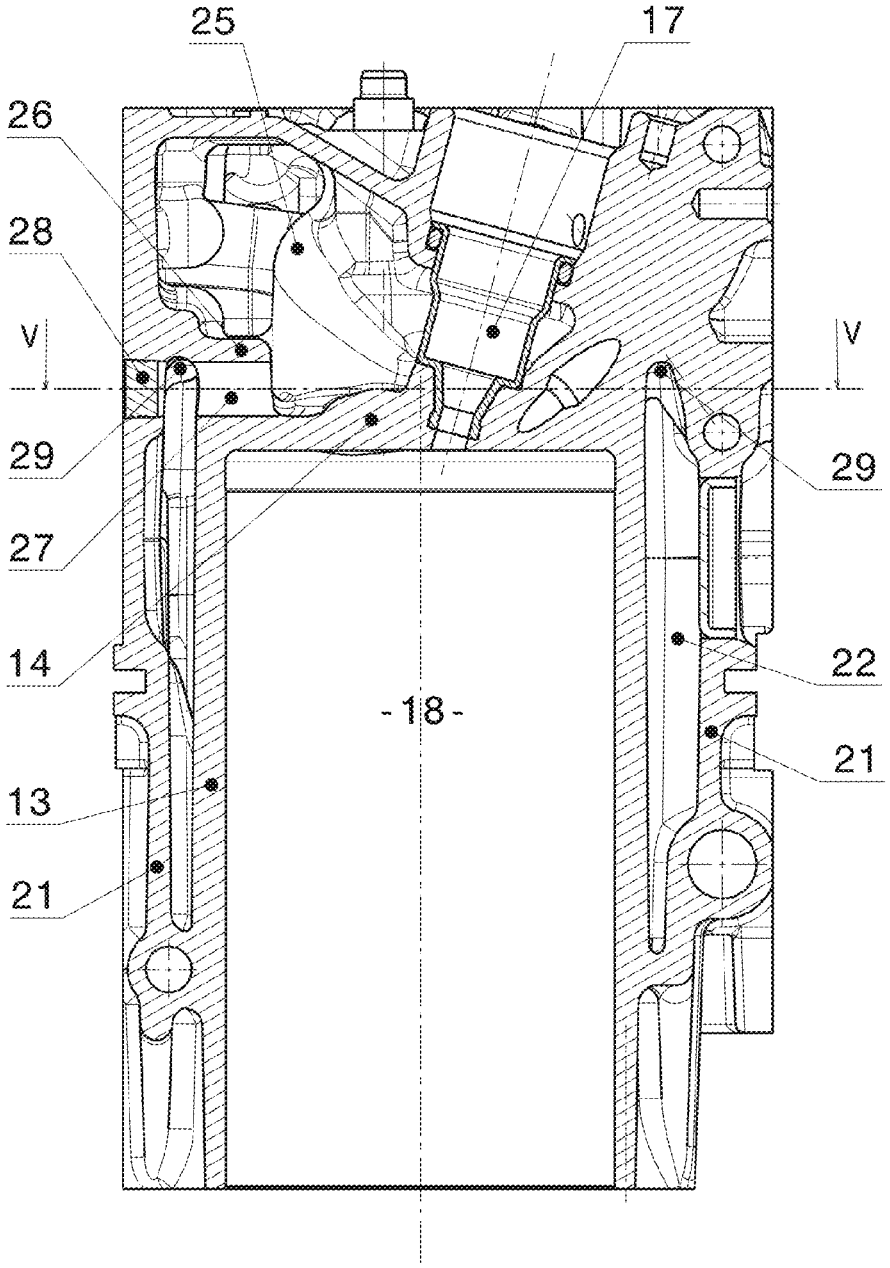
FIG. 3: A cross section of the engine of FIG. 2 along III-III in FIG. 5, FIG. 4: A cross section of the engine of FIG. 2 along IV-IV in FIG. 5, FIG. 5: A horizontal section of the engine of FIG. 2 along V-V in FIGS. 3, FIG. 6: A cross section through the mould for casting the engine block of FIG. 2, FIG. 7: A core mould for making a core part for the casting mould according to the inventive method.

FIG. 2 shows the engine block according to the invention in longitudinal section, the section being only through part of an engine of, for example, 6 cylinders. The engine block 10 comprises a cylinder part 11 and an integral head part 12. Each cylinder comprises a cylinder wall 13 and a cylinder ceiling 14 with an opening 15 for a suction valve, an opening 16 for an exhaust valve and an opening for an injector 17 (FIG. 3). An inlet channel 31 leads to opening 15 and an exhaust channel 32 (FIG. 4) starts from opening 16.

FIG. 3 is a first cross section of the engine block. Cylinder wall 13 and cylinder ceiling 14 enclose a combustion space 18 each. Each cylinder wall is enclosed by a first cooling space 22. It is common to all cylinders and its outer enclosure is an outer wall of the engine block 10. The first cooling space extends from the lower region of the engine block 10 upwards and ends higher than the outer surface of the cylinder ceiling 14 at 29. The first cooling space 22 forms a gap 23 (see FIG. 2) between adjacent cylinders. The width 35 of this gap 23 according to the invention is constant or decreases from bottom to top or even has a special contour. There could be a bridge between adjacent cylinders, for example. This gap 23 extends upwards beyond the cylinder ceiling 14 and ends in an extension 24 overlapping and partly embracing the cylinder ceiling 14. By this, the thickness of the cylinder wall 13 in the vulnerable region (8 in FIG. 1) is not reduced or even increased and the transition to the cylinder ceiling 14 is circumflown.

The cylinder head part 12 includes a second cooling space 25 separated from the first cooling space 22 by a partition wall 26. The partition wall 26 is of crumbled shape and, taking part in the in the formation of inlet channel 31, exhaust channel 32 and the opening for the injector 17, has also vertical regions. Between these, the partition wall 26 extends downwards until the outer surface of the cylinder ceiling 14 with which it merges. The second cooling space 25 thus ends lower than the top region 29 of the first cooling space 22. In order to connect the second cooling space 25 with the first cooling space 22, merely a first horizontal transverse bore needs to be drilled in the readily cast engine block and closed by a plug 28 at its outer end.

Figure 4:
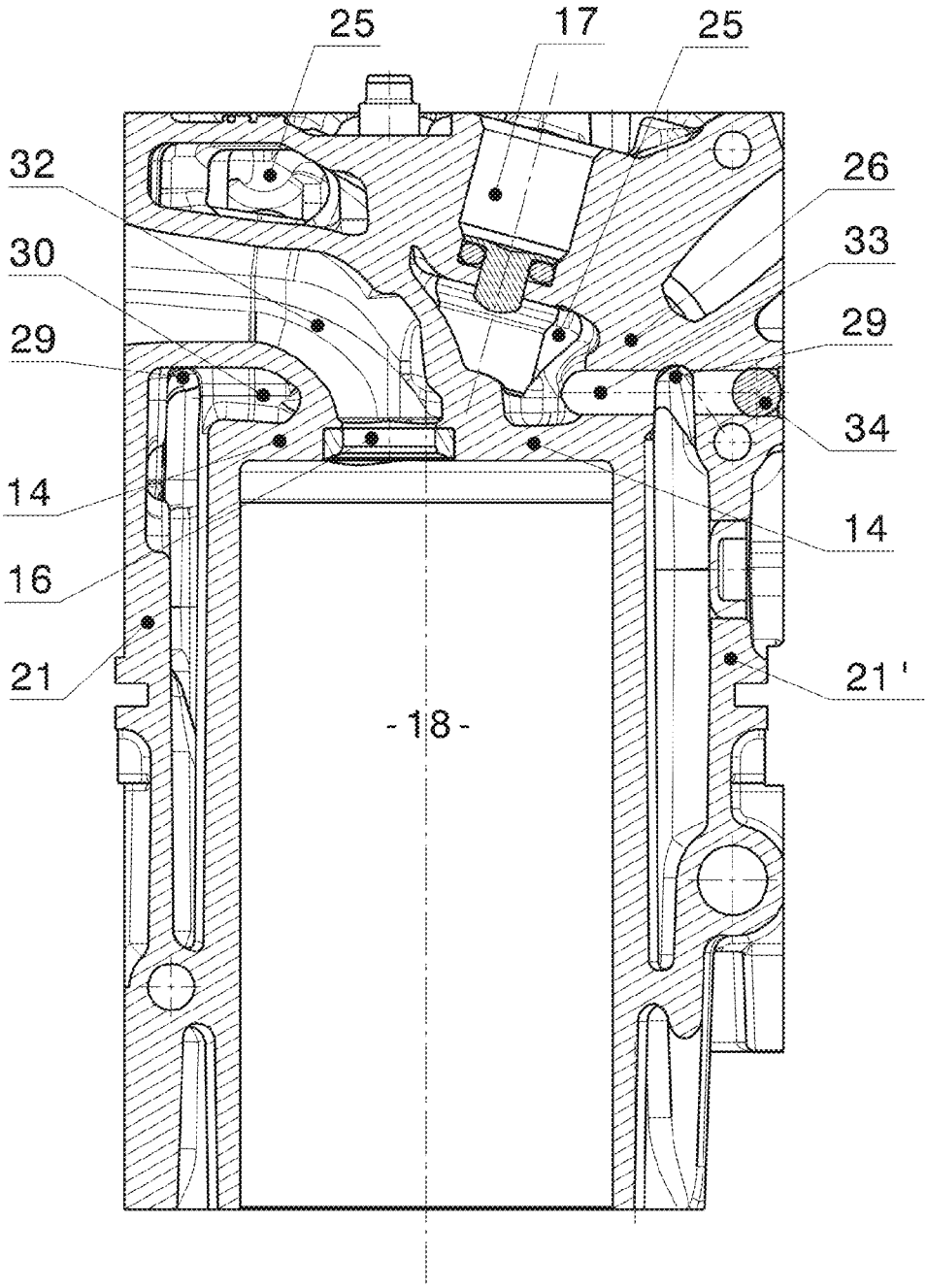

FIG. 4 shows a second section across the engine block 10 in a different parallel plane. This section runs across the opening 16 for the exhaust valve. Here, it is clearly visible that the first cooling space 22 very substantially overlaps the cylinder ceiling 14 in the region of the exhaust valve, at 30. A second transverse bore 33 can be seen here on the other longitudinal side 21' of the engine block, also connecting the first cooling space 22 with the second cooling space 25. Its outer end is closed by a ball 34. The second transverse bore 33 is directed towards the injector 17, cooling this sensitive organ as well.

Figure 5:
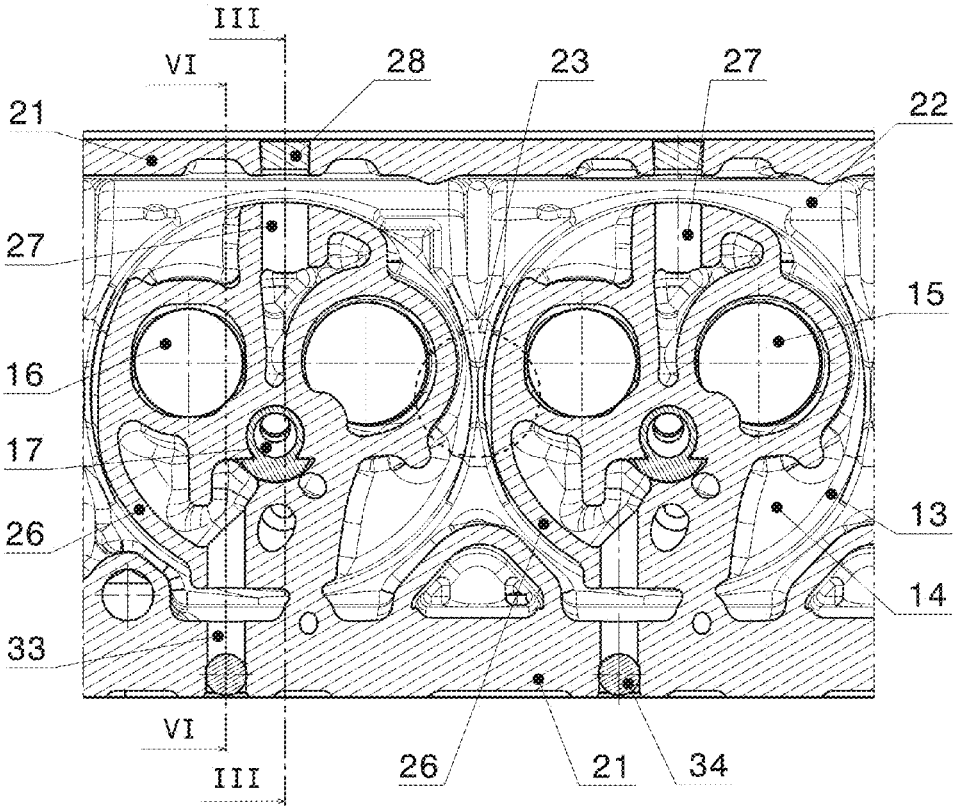

Horizontal section of FIG. 5 is in a plane through the center lines of the transverse bores 27, 33. It intersects the partition wall 26 separating the two cooling spaces (22,25), and also the outer walls 21, see the hatched patches. It shows the first cooling space 22 between the outer walls 21 and the cylinder walls 13 of the individual cylinders and the gap 23 between adjacent cylinders. The core, mentioned below, corresponds to the first cooling space 22. The core includes core parts in and around this gap 23, of particular concern. The situation would be similar with an engine with four valves per cylinder.

Figure 6:
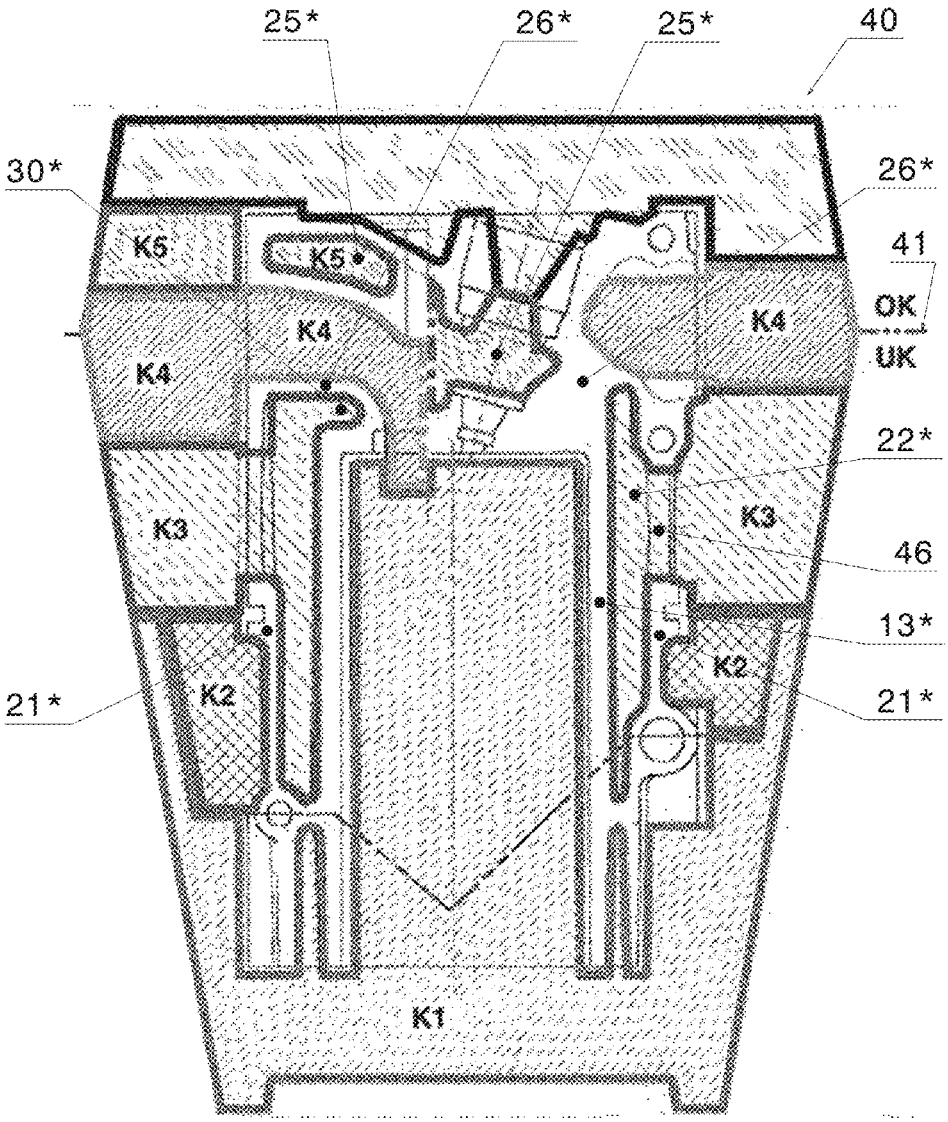

FIG. 6 shows the casting mould for casting an engine block according to the invention, summarily indicated with 40, as an introduction to the description of the casting method according to the invention. In a two-part core box (OK and UK), indicated only by the separation line 41, core parts—not shown in detail—are inserted. The core parts correspond to the hollows of the cast piece (for example core part 22* to the first cooling space 22, and so on). Essential for the invention is core part 22* for the first cooling space 22. Further core parts are core part 25* for the second cooling space 25 and the core parts corresponding to the channels 31, 32.

Figure 7:
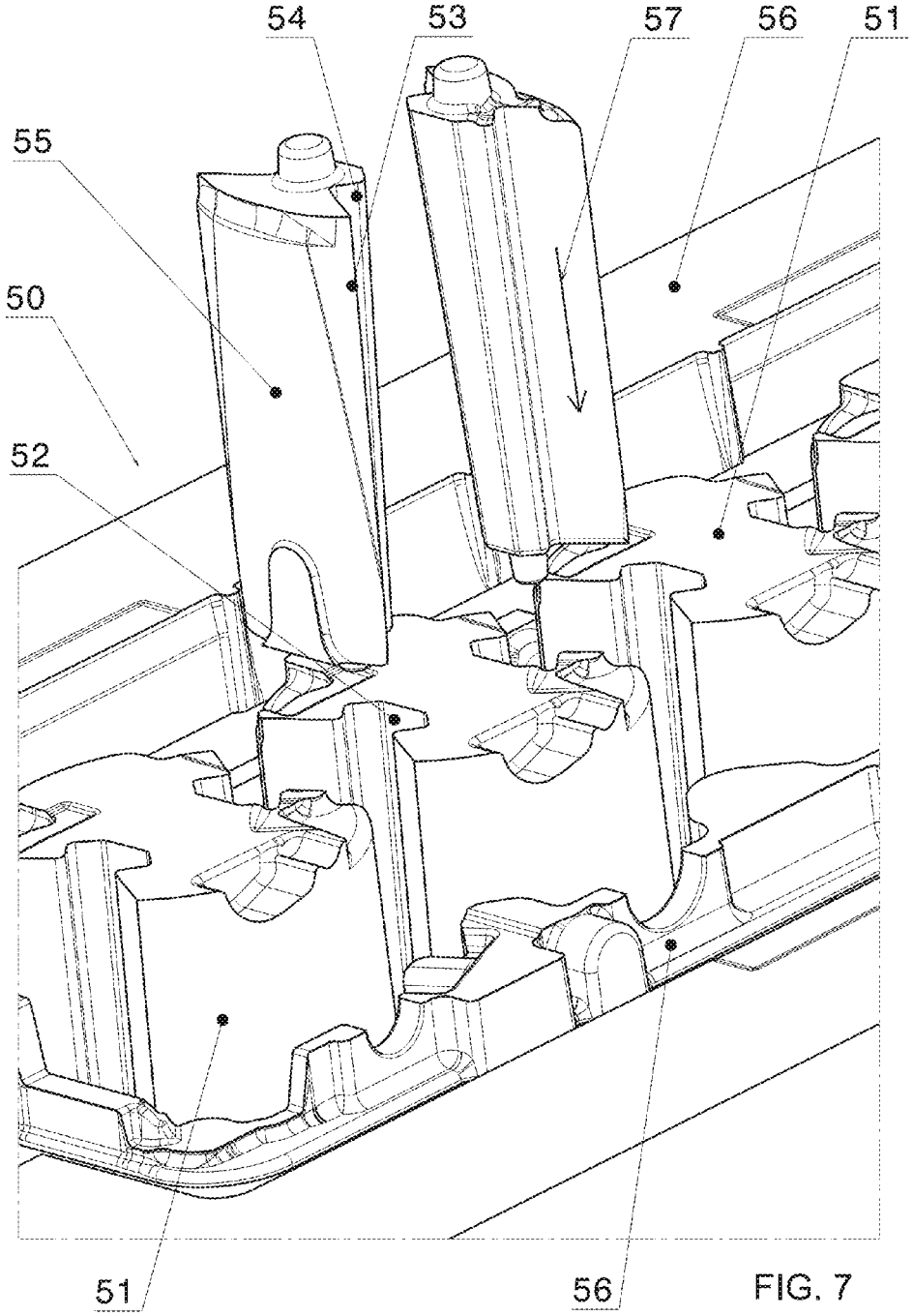

FIG. 7 depicts the forming tool essential for the casting process according to the invention. Its purpose is the making of the core part 22* and it is summarily indicated with 50. The inner contour of the outer walls 56 of the forming tool corresponds to the inner contour of the outer wall 21 of the engine block and the towers 51 correspond to the outer contour of cylinder wall 13 and cylinder ceiling 14. Each of the towers 51 has a vertical (thus not inclined by the draft angle) dovetail groove 52 for an insert 53 which is shifted (arrow 57) into the grooves in vertical direction as part of the forming tool for making the core part The insert 53 has a front surface 55 with a generatrix that is also vertical or even of arbitrary shape. In the latter case, the shape of the front surface can have particular features (for example also crevasses corresponding to a bridge between adjacent cylinders, not shown). The front surface 55 corresponds to the shape of core part 42 in the gap 23 between adjacent cylinders. As next step, the core part is built by insufflating core sand into the core mould 50. The so shaped core part 42 is extracted along the dovetail grooves 54 from the core mould together with the insert 53. This is enabled by the vertical guidance provided by the grooves 54. As next step, the inserts 53 are separated from the core part 42 in horizontal direction and core part 22* is ready for fitting in the mold, with the contour of the gap 23 according to the invention.

The invention claimed is:

1. Engine block of a diesel engine cast integrally with a cylinder head, comprising a plurality of cylinders in line, including an outer wall (21) and a cylinder wall (13) for each cylinder with a first cooling space (22) for a liquid cooling medium between them and with a second cooling space (25) on top of a cylinder ceiling (14) with openings (15,16) for gas exchange valves, the first cooling space (22) enclosing all the cylinder walls (13) entirely and extending all around upwards beyond the cylinder ceiling (14), wherein the first cooling space (22) between the cylinder walls (13) of adjacent cylinders forms a gap (23) with a width (35) which is one of (a) constant and (b) increasing from top to bottom, wherein the gap (23) extends upward beyond the cylinder ceiling (14) and ends in an extension (24) overlapping and partly embracing the cylinder ceiling (14).

2. Engine block according to claim 1, wherein the first cooling space (22) overlaps (30) the cylinder ceiling (14) at least in the region of the openings (16) for the exhaust valves.

3. Engine block according to claim 1, wherein a first horizontal transverse bore (27) is provided by means of which the two cooling spaces (22,25) are connected, the first transverse bore (27) penetrating an outer wall (21) and hitting the first cooling space (22), which cooling space (22) reaches beyond the cylinder ceiling (14), wherein a second horizontal transverse bore (33) is provided for connecting the two cooling spaces (22,25), the bore (33) penetrating the outer wall (21') on the opposite side and ending near the injector, in this way the cooling liquid flowing upwards from the first cooling space (22) is directed to the injector (17).

4. Engine block according to claim 1, wherein the outer wall (21) and the cylinder wall (13) for each cylinder are integral portions of the engine block cast integrally with the cylinder head.

5. Process for casting an engine block according to claim 1, wherein parts of a core are formed separately in core moulds and a core part (22*) corresponding to the first cooling space (22) is made in the region of the gap (23) between adjacent cylinders by means of separate inserts (43,53) having a shape which corresponds to the constant width of the gap or the width of the gap increasing from top to bottom, wherein the inserts (53) are slid into the core mould for shaping the core in vertical direction (57), and the core part made in the core mould (50) including the insert (53) is lifted out vertically and the insert is removed sideways.

6. Process according to claim 5, wherein the insert (53) has a dove-tail shaped guideway (54) at its backside which is opposite the side facing the core part (22*).

* * * * *